US007712953B2

(12) United States Patent
Scheufele

(10) Patent No.: US 7,712,953 B2
(45) Date of Patent: May 11, 2010

(54) VERTICAL CLUTCH DEVICE FOR TIMEPIECE

(75) Inventor: Karl-Friedrich Scheufele, Prangins (CH)

(73) Assignee: Chopard Manufacture SA, Fleurier (CH)

( * ) Notice: Subject to any disclaimer, the term of this patent is extended or adjusted under 35 U.S.C. 154(b) by 56 days.

(21) Appl. No.: 12/136,790

(22) Filed: Jun. 11, 2008

(65) Prior Publication Data

US 2008/0304370 A1 Dec. 11, 2008

(30) Foreign Application Priority Data

Jun. 11, 2007 (EP) ..... 07011353

(51) Int. Cl.
*G04B 27/04* (2006.01)

(52) U.S. Cl. ..... 368/191; 368/101

(58) Field of Classification Search ..... 368/220, 368/101–106, 191
See application file for complete search history.

(56) References Cited

U.S. PATENT DOCUMENTS 3,842,591 A * 10/1974 Dubois et al. ..... 368/104
2006/0153012 A1* 7/2006 Oomori et al. ..... 368/319
2008/0310257 A1* 12/2008 Perret et al. ..... 368/106

FOREIGN PATENT DOCUMENTS

CH 538716 1/1973
EP 1791043 5/2007

OTHER PUBLICATIONS

European search report in corresponding EP 07011353.

* cited by examiner

*Primary Examiner*—Vit W Miska
*Assistant Examiner*—Sean Kayes
(74) *Attorney, Agent, or Firm*—Young & Thompson

(57) ABSTRACT

Clutch device for timepiece, comprising first and second coaxial rotary mobile parts (1, 2) able to take up a relative axial coupled position in which a rotation of the first mobile part (1) gives rise to a rotation of the second mobile part (2), and a relative axial uncoupled position in which a rotation of the first mobile part (1) does not give rise to a rotation of the second mobile part (2), characterised in that is also comprises a friction element of viscoelastic material (30) intercalated between the mobile parts (1, 2) in order to transmit the rotation of the first mobile part (1) in the coupled position to the second mobile part (2).

14 Claims, 3 Drawing Sheets

VERTICAL CLUTCH DEVICE FOR TIMEPIECE

The present invention relates to a clutch device for a timepiece and more particularly for a chronograph.

In a chronograph, the chronograph wheel that holds the chronograph hand is linked with the seconds wheel via a clutch. The clutch can take up a coupled position corresponding to the chronograph's working position where the chronograph wheel is driven by the seconds wheel, and an uncoupled position corresponding to the chronograph's stopping position where the chronograph wheel is not driven by the seconds wheel and is immobilised by a brake.

The present invention relates to a type of clutch that is particularly appreciated, that is, the vertical clutches. Contrary to the horizontal clutches, the vertical clutches do not cause any jumping of the chronograph hand when the chronograph is set to work.

A vertical clutch generally comprises on one and the same arbor a first mobile part comprising a toothed wheel, and a second mobile part comprising another toothed wheel and a coupling cone. The toothed wheel of the first mobile part is engaged with the seconds wheel. The toothed wheel of the second mobile part is engaged with the chronograph wheel. The coupling cone cooperates with a clamp which in its opening and closing is controlled by a column wheel. Closing of the clamp moves the mobile parts apart against the action of a spring, whereas an opening of the clamp brings the mobile parts into mutual contact under the action of the spring. With the clamp open (coupled position), the mobile parts are kept in mutual contact by the spring, and the first mobile part drives the second mobile part by friction. With the clamp closed (uncoupled position), the second mobile part is not in contact with the first mobile part, and thus is not driven.

For sufficient friction between the mobile parts in the coupled position, the spring that keeps them in contact must have a large force. Moreover, grease usually is used to produce adhesion in the metal—metal contact of the mobile parts. This grease is degraded rather rapidly with time, and thus must be regularly replaced. In addition, this grease does not remain in place, and by moving within the chronograph mechanism may damage it or at least disturb its operation.

The present invention aims at providing a vertical clutch device that permits using a spring of smaller force and does not require use of the grease just cited.

To this end a clutch device for timepiece and notably for chronograph is provided that comprises first and second coaxial, rotary mobile parts that can assume a relative axial coupled position in which a rotation of the first mobile part causes a rotation of the second mobile part, and a relative axial uncoupled position in which a rotation of the first mobile part does not cause a rotation of the second mobile part, characterised in that it further comprises a friction element of a viscoelastic material intercalated between the mobile parts so as to transmit the rotation of the first mobile part to the second mobile part in the coupled position.

Particular embodiments of the invention are defined in the appended dependent claims 2 to 7.

The present invention also provides a chronograph mechanism such as defined in the appended claim 8.

Further characteristics and advantages of the present invention will become apparent when reading the following detailed description of a preferential embodiment that is given while referring to the appended drawings in which.

Figure 1:
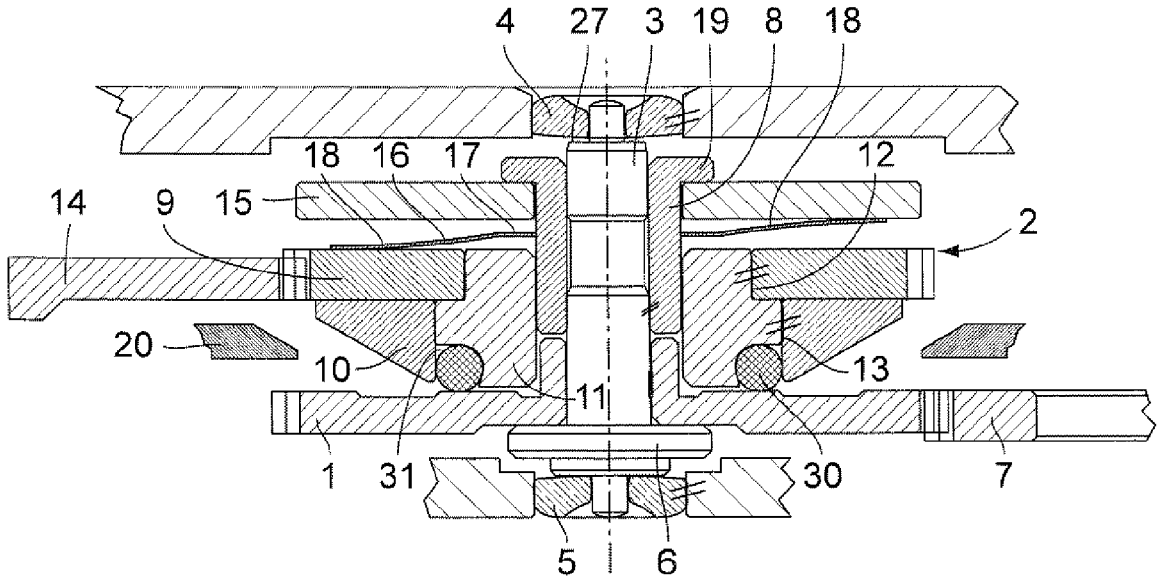
FIG. 1 is a view in axial section of a clutch according to the invention, in a coupled condition.

Referring to FIGS. 1 to 4, a vertical clutch device for chronograph according to the invention comprises a lower rotary mobile part 1 and an upper rotary mobile part 2, both mounted on a coupling axis 3 pivoted in two bearings 4, 5. The lower mobile part 1 consists of a toothed wheel mobile in rotation around the axis 3 and resting on a collar 6 of axis 3. This lower mobile part 1 is permanently engaged with the seconds wheel 7 of the movement that makes one revolution per minute. The upper mobile part 2 is movably mounted about axis 3, or more precisely about a pipe 8 driven onto axis 3. The upper mobile part 2 consists of several coaxial elements rigidly assembled, viz., a toothed wheel called upper coupling wheel 9, a coupling cone 10, and a coupling pipe 11. The coupling pipe 11 surrounds pipe 8, so as to be mobile in rotation and in translation, and at its periphery has bearing surfaces 12, 13 onto which are driven the upper coupling wheel 9 and the coupling cone 10. Coupling cone 10 is located between the upper coupling wheel 9 and the lower mobile part 1, and by its annular upper flat surface is in contact with the annular lower flat surface of the upper coupling wheel 9. The upper coupling wheel 9 is permanently engaged with the chronograph wheel 14 the arbor of which holds the chronograph hand, that is, the hand of the seconds counter.

Figure 2:
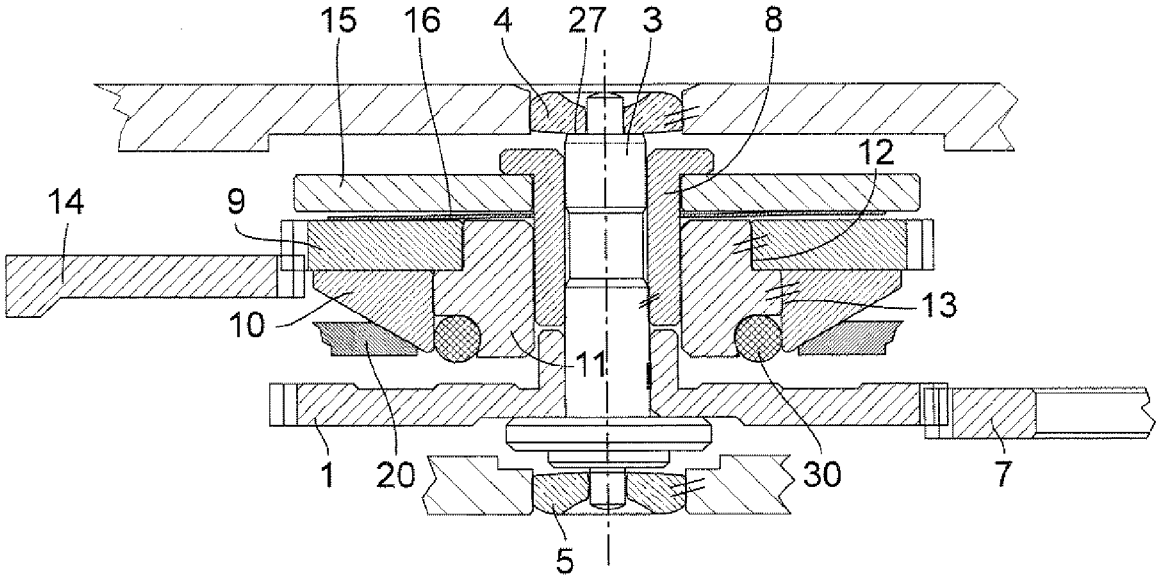
FIG. 2 is a view in axial section of the clutch according to the invention, in an uncoupled condition.

A washer 15 movably mounted in rotation around pipe 8 above the upper mobile part 2 is separated from the upper coupling wheel 9 by a spring 16. Spring 16 has an annular central segment 17 that surrounds pipe 8, and a certain number of blades 18, for example six, extending from the central segment 17, one out of any two resting on the upper coupling wheel 9 and the others resting on washer 15. In FIGS. 1 and 2, two blades 18 only can be seen. Spring 16 keeps washer 15 axially abutting an annular shoulder 19 of pipe 8, and tends to move the upper mobile part 2 away from washer 15, so as to bring the upper mobile pad 2 closer to the lower mobile part 1.

The upper mobile part 2 can move in axial translation on pipe 8 between a coupled position represented in FIG. 1 where the upper mobile part 2 is pressed against the lower mobile part 1, and an uncoupled position represented in FIG. 2 where the mobile parts 1, 2 have been moved apart. In the coupled position, the lower mobile part 1 drives the upper mobile part 2 by friction, so that the movement of the seconds wheel 7 is transmitted to the chronograph wheel 14. The frictions between pipe 8, upper mobile part 2, spring 16 and washer 15 have the effect that elements 1, 2, 3, 8, 15, and 16 in the coupled position rotate jointly. In the uncoupled position, the lower mobile part 1 rotates without driving the upper mobile part 2, and hence does not transmit the movement from the seconds wheel 7 to the chronograph wheel 14.

Figure 3:
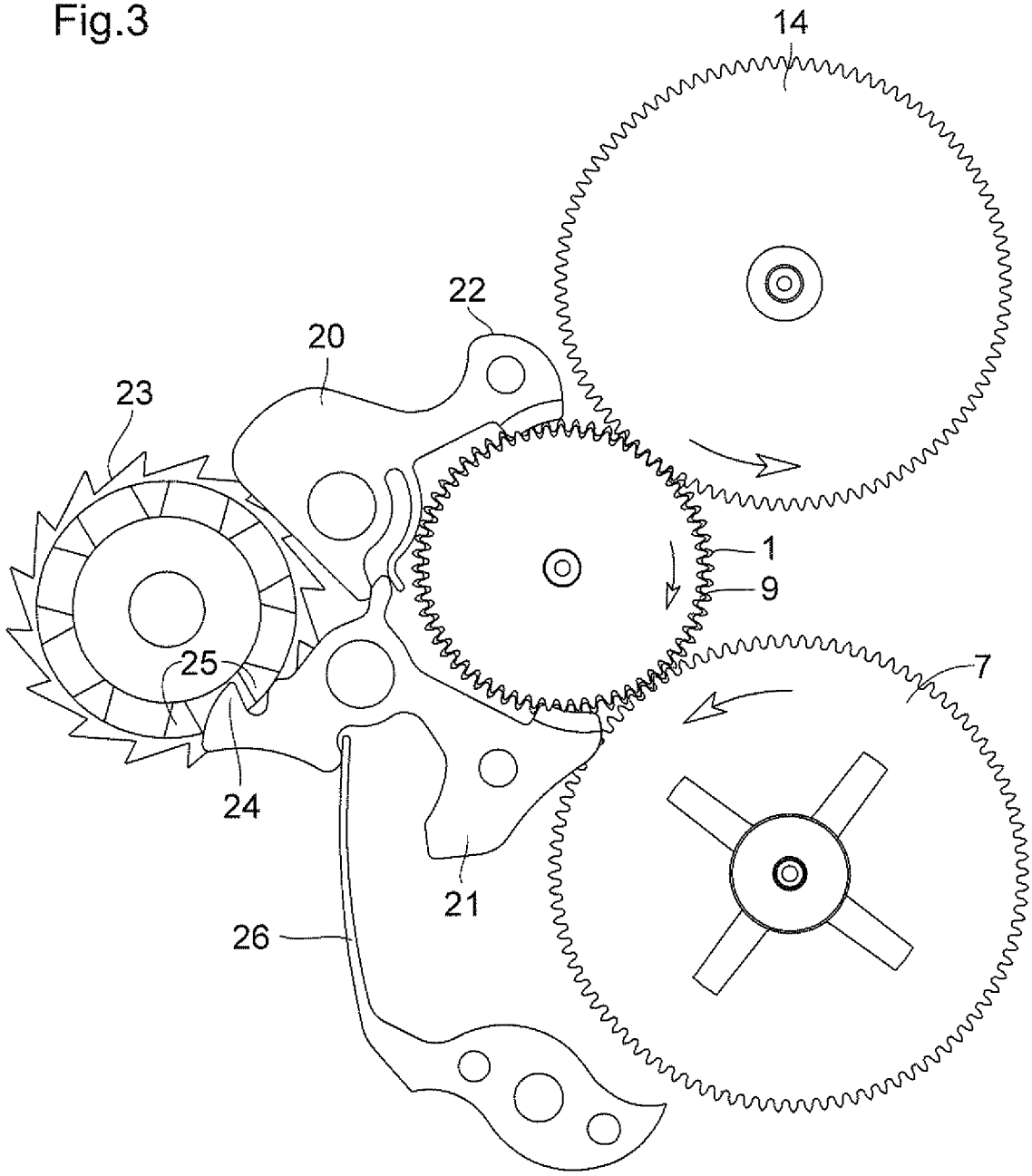
FIG. 3 is a plan view from above, of the clutch according to the invention in the coupled condition.
Figure 4:
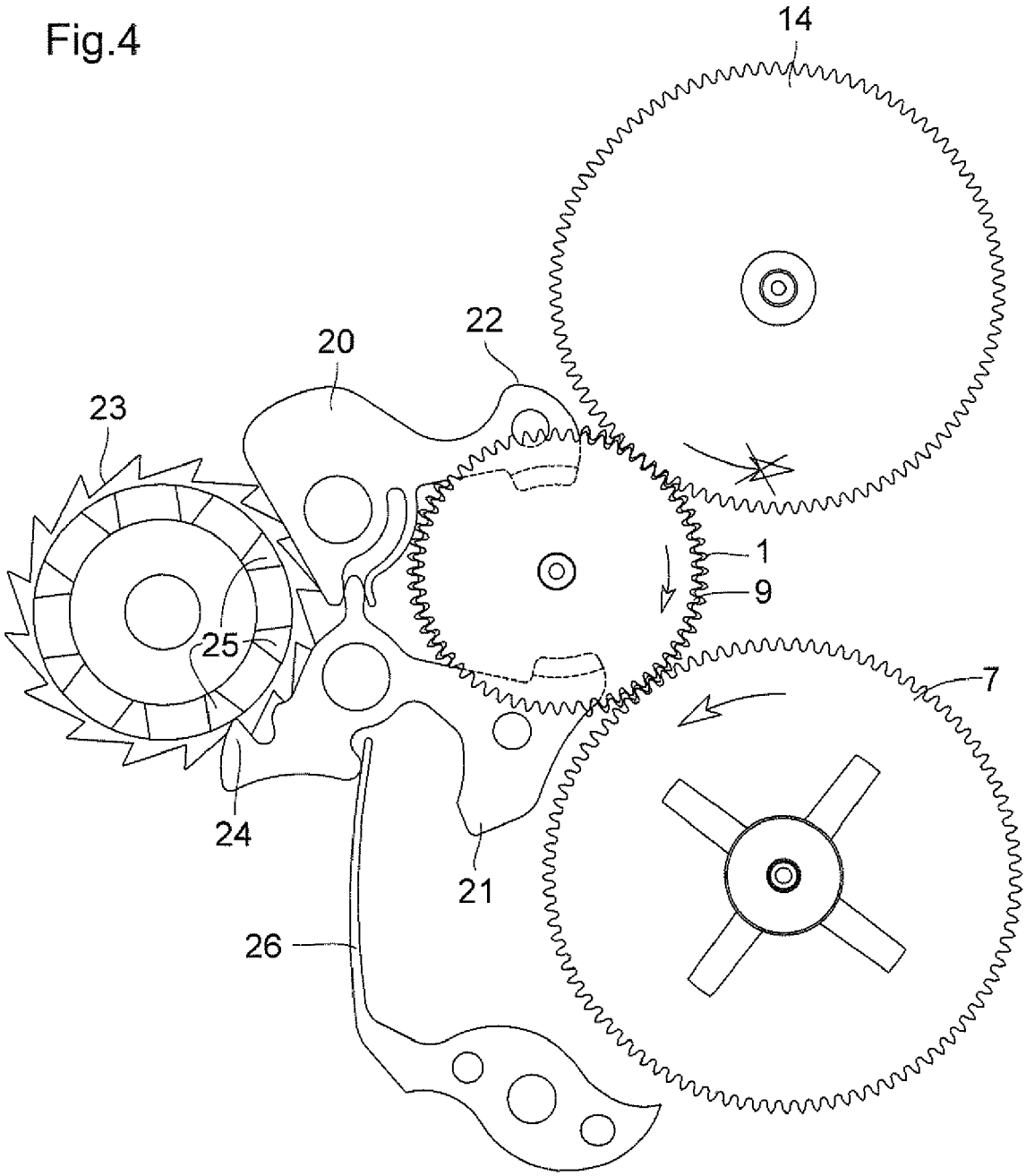
FIG. 4 is a plan view from above, of the clutch according to the invention in the uncoupled condition.

The axial displacement of the upper mobile part 2 is controlled by a clamp 20 that can be closed so as to come into contact with the coupling cone 10 and raise it against the action of spring 16 (FIGS. 2 and 4), or opened so as to allow spring 16 to push the upper mobile part 2 against the lower mobile part 1 (FIGS. 1 and 3). As is apparent from FIGS. 3 and 4, one 21 of the two arms 21, 22 of clamp 20 controls the other arm 22, and cooperates with a column wheel 23 through a beak 24. In the classical way, column wheel 23 is controlled by a start-stop push button (not represented) of the chronograph. Every time the push button is pressed, the column wheel 23 will turn by one step, which closes or opens clamp 20 depending on the position of beak 24 relative to the columns. In every other angular position of the column wheel 23 (FIG. 4), beak 24 rests against a column 25 of wheel 23 against the action of a return spring 26 of clamp 20, which keeps clamp 20 in its closed position. In the remaining angular positions of column wheel 23 (FIG. 3), beak 24 is between two columns 25, and clamp 20 is kept in its open position by the action of return spring 26.

During the change from the coupled to the uncoupled position, clamp 20 pushes the upper mobile part 2 against washer 15 while spring 16 remains between them, which causes the entire set of 1, 2, 3, 8, 15, and 16 to rise up to the point where a shoulder 27 of axis 3 rests against the upper bearing 4. In the uncoupled position, the frictions between axis 3 and bearing 4, between pipe 8, upper mobile part 2, washer 15, and spring 16, and between clamp 20 and coupling cone 10 have the effect that the set of 2, 3, 8, 15, and 16 stops turning, which stops the chronograph wheel 14. No specific brake is needed, therefore, to stop the chronograph wheel 14. The lower mobile part 1 turns around axis 3 in this uncoupled position.

During zero resetting of the chronograph after its stopping, a hammer (not represented) strikes a heart-shaped cam, which causes the chronograph wheel 14 to rotate to the zero position of the chronograph hand. This rotation of chronograph wheel 14 gives rise to a rotation of the upper mobile part 2. Washer 15 and spring 16 are driven in this rotation by friction with the upper mobile part 2, the set of 2, 15, 16 thus turning around axis 3 and pipe 8.

The chronograph may include a function known as "fly-back" that allows a resetting of the chronograph to zero while it is working. In this case clamp 20 is closed by a lever (not represented) under the action of a zero-resetting push button so as to stop the chronograph, and the zero-resetting hammer is then actuated.

According to the invention, mobile parts 1, 2 in the coupled position of the clutch are not pushed against one another directly but, rather, via a gasket 30 made of a viscoelastic material. This gasket 30 has an annular, typically toric, shape coaxial with axis 3 and is housed in an annular recess 31 that is defined by the coupling pipe 11 and the coupling cone 10 and is open downward, that is, toward the lower mobile part 1. Part of gasket 30 projects beyond recess 31, so that in the coupled position of the clutch gasket 30 is squeezed between the bottom of recess 31 and the lower mobile part 1 by the action of spring 16 while the lower and upper mobile parts 1, 2 are not touching. In this coupled position, the friction developing on the one hand between gasket 30 and the lower mobile part 1 and on the other hand between gasket 30 and the upper mobile part 2 prevents any slipping of the upper mobile part 2 relative to the lower mobile part 1, and thus makes these two mobile parts 1, 2 solid in rotation. In the uncoupled position of the clutch, gasket 30 does not touch the lower mobile part 1 any more, so that the upper mobile part 2 is disconnected from the lower mobile part 1.

In practice, gasket 30 has an inner diameter that is smaller than the smallest inner diameter of recess 31, so that gasket 30 is introduced and held in recess 31 by being radially stretched there. The elements of the upper mobile part 2 are assembled by first placing gasket 30 around the coupling pipe 11, then driving the coupling cone 10 around coupling pipe 11 and gasket 30.

Thanks to gasket 30, strong friction is obtained between the lower and upper mobile parts 1, 2 in the coupled position, so that spring 16 need not be strong, that is, need not be strongly tensioned. The risk of permanent deformation or rupture of spring 16 thus is limited. Moreover, using friction grease is no longer necessary.

The viscoelastic material forming gasket 30 is, for example, natural rubber or synthetic rubber such as neoprene, polybutadiene, polyurethane, silicone, etc. The lower and upper mobile parts 1, 2 may be made of any appropriate material, typically a metallic material.

In a variant realization, gasket 30 could be housed in the lower mobile part 1 rather than in the upper mobile part 2.

The invention claimed is:

1. A clutch device for a timepiece, comprising:

first and second coaxial rotary mobile parts (1, 2) mounted on an axis (3) and able to take up a relative axial coupled position in which rotation of said first mobile part (1) causes rotation of said second mobile part (2) and a relative axial uncoupled position in which rotation of said first mobile part (1) does not cause rotation of said second mobile part (2);

a clamp (20) moving said second mobile part axially relative to said first mobile part;

said second mobile part comprising a pipe (11) surrounding said axis (3) and a member (10) surrounding and rigidly assembled to said pipe, said member (10) being actuable by said clamp (20); and a friction element of viscoelastic material (30) intercalated between said first and second mobile parts (1, 2) so as to transmit rotation of said first mobile part (1) to said second mobile part (2) in said coupled position, said friction element being housed partly in a cavity (31) defined by said pipe (11) and said member (10).

2. The clutch device according to claim 1, wherein said viscoelastic material comprises natural or synthetic rubber.

3. The clutch device according to claim 2, wherein said friction element (30) has an annular shape and is coaxial with the first and second mobile parts (1, 2).

4. The clutch device according to claim 2, wherein said clamp (20) is closed to cooperate with a cone (10) of the second mobile part (2) and cause the first and second mobile parts to change from their relative axial coupled position to their relative axial uncoupled position, and opened to allow the second mobile part (2) to be pushed via the friction element (30) against the first mobile part (1) by a spring (16) to cause the first and second mobile parts (1, 2) to change from their relative axial uncoupled position to their relative axial coupled position.

5. The clutch device according to claim 2, wherein said first and second mobile parts (1, 2) each comprise a toothed wheel (1, 9).

6. Clutch device according to claim 1, wherein said friction element (30) has an annular shape and is coaxial with said first and second mobile parts (1, 2).

7. The clutch device according to claim 6, wherein said clamp (20) is closed to cooperate with a cone (10) of the second mobile part (2) and cause the first and second mobile parts to change from their relative axial coupled position to their relative axial uncoupled position, and opened to allow the second mobile part (2) to be pushed via the friction element (30) against the first mobile part (1) by a spring (16) to cause the first and second mobile parts (1, 2) to change from their relative axial uncoupled position to their relative axial coupled position.

8. The clutch device according to claim 6, wherein said first and second mobile parts (1, 2) each comprise a toothed wheel (1, 9).

9. The clutch device according to claim 1, wherein said clamp (20) is closed to cooperate with a cone (10) of the second mobile part (2) and cause the first and second mobile parts to change from their relative axial coupled position to their relative axial uncoupled position, and opened to allow the second mobile part (2) to be pushed via the friction element (30) against the first mobile part (1) by a spring (16) to cause the first and second mobile parts (1, 2) to change from their relative axial uncoupled position to their relative axial coupled position.

10. The clutch device according to claim 9, wherein said first and second mobile parts (1, 2) each comprise a toothed wheel (1, 9).

11. The clutch device according to claim 1, wherein said first and second mobile parts (1, 2) each comprise a toothed wheel (1, 9).

12. A chronograph mechanism comprising:

the clutch device according to claim 11, a seconds wheel (7) engaged with the toothed wheel (1) of the first mobile part, and a chronograph wheel (14) engaged with the toothed wheel (9) of the second mobile part.

13. The clutch device according to claim 1, wherein said first and second mobile parts (1, 2) each comprise a toothed wheel (1, 9).

14. The clutch device according to claim 1, wherein said member is a cone.

* * * * *